United States Patent [19]

Bowyer

[11] Patent Number: 4,772,078

[45] Date of Patent: Sep. 20, 1988

[54] DRAWER INTERLOCKING MEANS FOR STORAGE CABINET

[75] Inventor: Stephen M. Bowyer, Fruitport, Mich.

[73] Assignee: Meridian, Inc., Spring Lake, Mich.

[21] Appl. No.: 58,028

[22] Filed: Jun. 4, 1987

[51] Int. Cl.[4] ..... E05B 65/46; E05C 7/06

[52] U.S. Cl. ..... 312/221; 312/220

[58] Field of Search ..... 312/215, 216, 217, 218, 312/219, 220, 221, 222, 107.5

[56] References Cited

U.S. PATENT DOCUMENTS

| | | | |
|---|---|---|---|
| 1,063,844 | 6/1913 | Swanson | 312/221 |
| 1,200,882 | 10/1916 | Schaefer | 312/107.5 |
| 2,835,547 | 5/1958 | Erismann | 312/219 |
| 2,992,056 | 7/1961 | Thielker | 312/221 |
| 3,371,974 | 3/1968 | Vermeersch | 312/221 |
| 3,454,320 | 7/1969 | Olree | 312/217 |
| 3,791,708 | 2/1974 | Signore | 312/221 |
| 3,883,199 | 5/1975 | Cawley, Jr. et al. | 312/216 |
| 3,909,090 | 9/1975 | Breckner et al. | 312/222 |
| 3,936,108 | 2/1976 | Chitester | 312/219 |
| 4,303,287 | 12/1981 | Taplin | 312/221 |
| 4,441,767 | 4/1984 | Stark | 312/221 |
| 4,480,883 | 11/1984 | Young | 312/220 |
| 4,605,266 | 8/1986 | McKernan et al. | 312/220 |

FOREIGN PATENT DOCUMENTS

| | | | |
|---|---|---|---|
| 3431386 | 3/1986 | Fed. Rep. of Germany | 312/221 |

*Primary Examiner*—Victor N. Sakran

*Attorney, Agent, or Firm*—Reising, Ethington, Barnard, Perry & Milton

[57] ABSTRACT

A file storage assembly having a string or stack of elements vertically disposed along one side to allow only one drawer to be opened at a time. A shaft (48) having inclined cam surfaces (50,52) at opposite ends is associated with each drawer and includes a pinion (44) rotated by engagement with a rack (46) on the drawer during opening of the drawer. Upon rotation of the shaft (48), the cam surfaces (50,52) at the ends thereof vertically move the shafts (48) of the other drawers to vertically move one of a pair of locking lugs (64) on the shafts (48) into horizontal alignment with a lug (78) on the drawer (38) to prevent opening of all other drawers. A key projection (66) extends from the housing between each pair of lugs (64) upon rotation of the shaft (48) during opening movement of the drawer to prevent vertical movement of the operative shaft (48). All of the shafts (48) may be moved vertically upward in unison by a security lock (84) connected through linkage (82,88,96) extending across the bottom and up the other side of the cabinet.

28 Claims, 7 Drawing Sheets

DRAWER INTERLOCKING MEANS FOR STORAGE CABINET

TECHNICAL FIELD

The subject invention relates to lateral and vertical file storage cabinets having vertically stacked drawers, and more particularly to an interlocking assembly for allowing the withdrawal of only one drawer at a time.

BACKGROUND ART

File storage cabinets are used for filing documents and are generally of the vertical and lateral type. Such file cabinets usually include a number of file drawers vertically stacked with each file drawer being movable from within the cabinet housing to an extended open position to provide access to the drawer space. In a vertical file cabinet the length of the file drawer extends out of the file cabinet housing with the files extending across the drawer, whereas in a lateral file drawer the length of the drawer extends across the cabinet housing so that when the drawer is opened it is moved transverse to its length.

It very frequently occurs that if more than one drawer is moved to the open position at the same time, the file cabinet assembly has a tendency to tip forward in the opening direction of the drawers. In other words, the center of gravity of the cabinet is shifted sufficiently forward that the entire assembly becomes unstable and can dangerously fall forward, sometimes causing injury to a party standing in front of the cabinet.

Hundreds of mechanisms have been developed to overcome this tipping problem by preventing more than one drawer from being opened at the same time. Many of these systems include mechanisms disposed along one side of the drawers for being moved to a locking position in response to opening movement of one of the drawers.

U.S. Pat. No. 3,454,320 to Olree discloses a system having a rod with a radially extending actuating arm associated with each drawer for rotating the rod upon opening movement of the drawer to rotate a second locking arm associated therewith into interfering position with each of the other drawers. A major deficiency in this system is that it allows two drawers to rotate the rod simultaneously during opening movement of both drawers.

The U.S. Pat. No. 3,883,199 to Cawley, Jr. et al. discloses yet another system utilizing a rotating rod with arms that coact with the drawers for rotating the rod to a locking position upon opening of one of the drawers. The mechanism incorporates a security locking system whereby the rod may be moved vertically for preventing opening of all of the drawers. It, however, has the similar deficiency of allowing two drawers to be opened simultaneously.

There are also systems including vertically stacked elements, one or more of which are vertically movable to drawer-locking positions in response to opening movement of one of the drawers. Exemplary of such a system is that shown in U.S. Pat. No. 4,480,883 to Young wherein the stack of elements includes a cam associated with each drawer opening for rotation about a horizontal axis in response to opening movement of the associated drawer to vertically move the other elements in the stack to prevent any of the other cams from rotating, thereby blocking the opening movement of the other drawers. In this system the contacting surfaces between the cam and the drawer are the same for rotating the cam during opening movement of the drawer as for preventing the drawer from being opened by the cam when the cam is prevented from rotating because of another cam in the system having been rotated as a result of another drawer being opened. In other words, the actuating surfaces between the cam and the drawer are the same as the locking surfaces between the mechanism and the drawer.

SUMMARY OF THE INVENTION AND ADVANTAGES

A storage assembly comprising a housing means defining an enclosure with a plurality of storage units each supported by the housing means for movement between a closed position within the enclosure and an open position extending out of the housing means. The assembly includes blocking means disposed on a vertical axis along side of the storage units for preventing opening movement from the closed position of all but one of the storage units in response to opening movement of one of the storage units. The blocking means is characterized by including control means associated with each storage unit and vertically movable between a neutral opening position allowing opening movement of the associated storage unit and upper and lower blocking positions respectively vertically above and below the neutral opening position for preventing opening movement of the associated storage unit in either of the blocking positions and for vertically moving all other of the control means to their respective blocking positions while remaining in the neutral opening position in response to initial opening movement of the associated storage unit.

An advantage of utilizing a control means, which is vertically movable to upper and lower blocking positions in response to actuation of another control means by its associated drawer means, is the very secure blocked feeling of the drawers. Two drawers may be pulled simultaneously without any appreciable movement, i.e., a totally locked feeling. This closer tolerance operational feeling may be obtained by this separation of the locking coacting surfaces from the operative coacting surfaces during its movement toward the open position.

FIGURES IN THE DRAWINGS

Other advantages of the present invention will be readily appreciated as the same becomes better understood by reference to the following detailed description when considered in connection with the accompanying drawings wherein.

Figure 1:
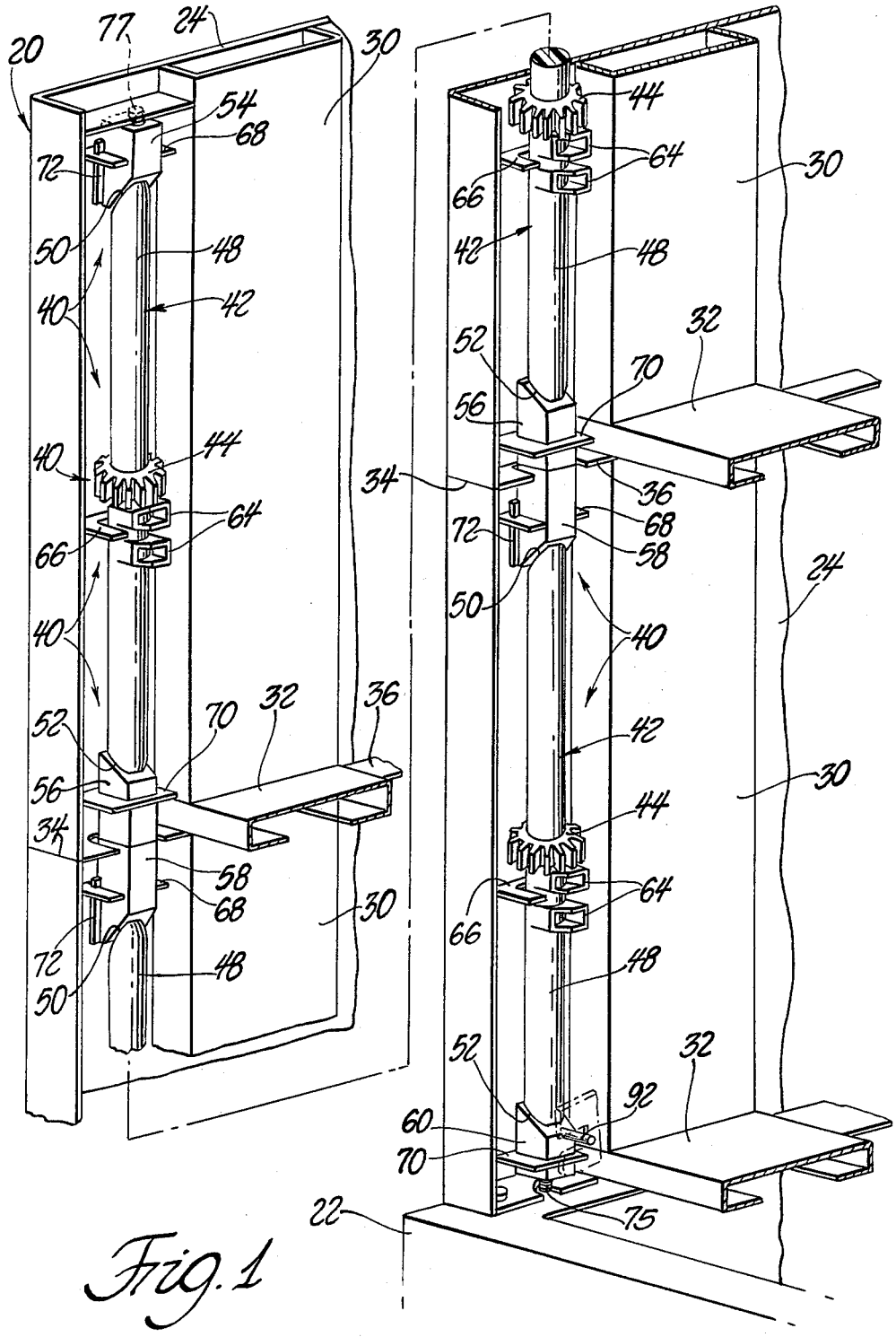
FIG. 1 is a fragmentary perspective view partially broken away and in cross section of a preferred embodiment of the subject invention.
Figure 7:
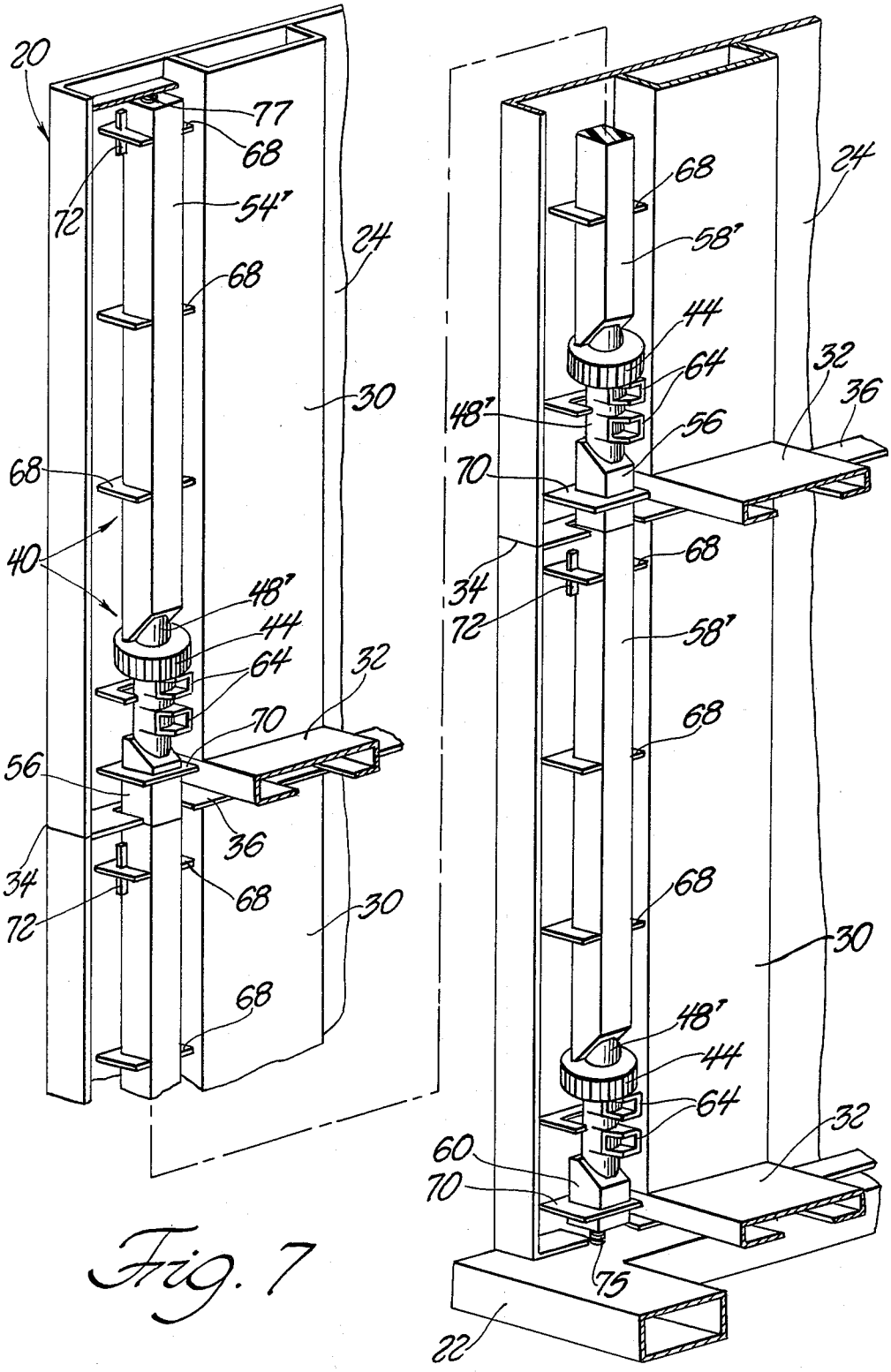
FIG. 7 is a fragmentary perspective view of an alternative embodiment of the subject invention particularly suited for use in a vertical type storage assembly by utilizing elements of different vertical dimension than those of the previous embodiment.
Figure 8:
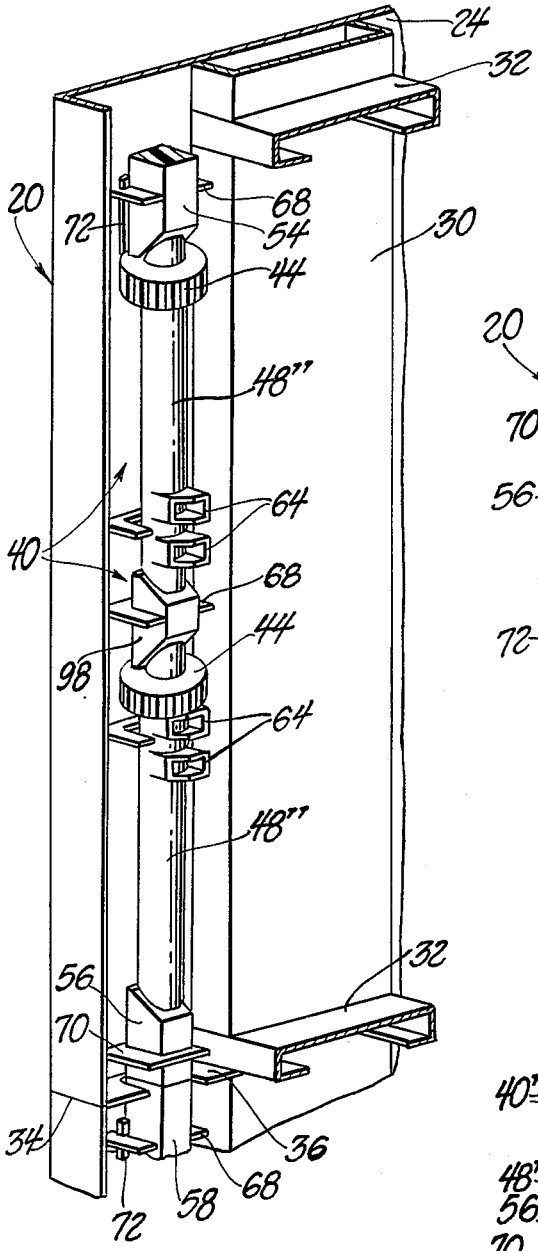
Figure 9:
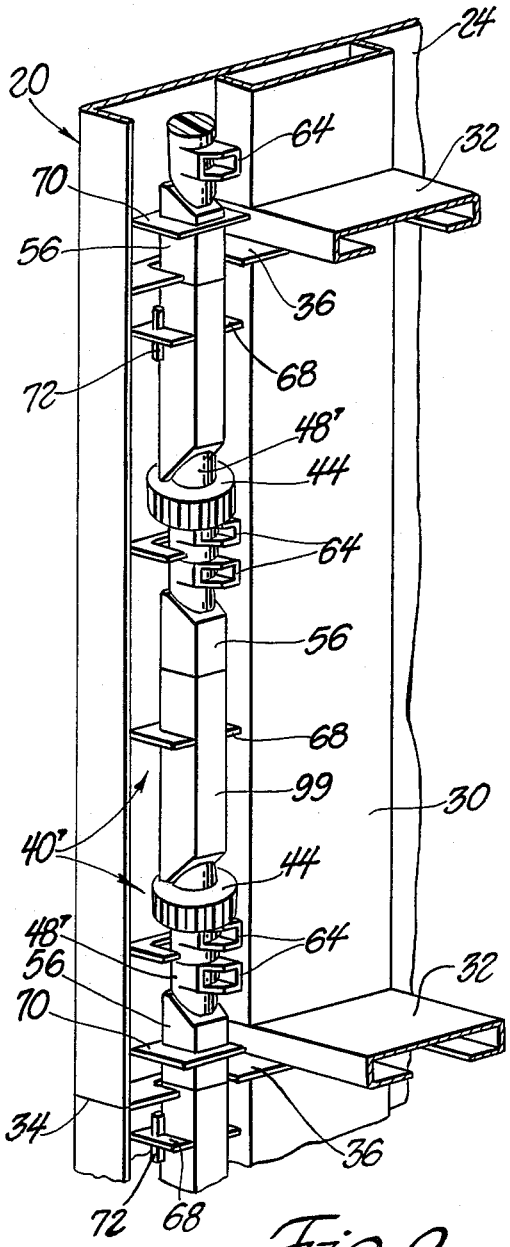

FIG. 8 is a fragmentary perspective view of yet another embodiment for use in a lateral type storage assembly like that of FIG. 1 but with elements of different vertical dimensions to accommodate drawer sizes of lesser vertical dimension; and FIG. 9 is a fragmentary perspective view of an alternative embodiment for use in a vertical type storage assembly like that of FIG. 7 but with elements of different vertical dimension to accommodate drawer sizes of smaller vertical dimension.

DESCRIPTION OF THE PREFERRED EMBODIMENT OF FIGS. 1–6

The embodiment illustrated in FIGS. 1 through 6 is particularly suited for use in a lateral type file storage cabinet assembly.

Referring to the FIGURES where like numerals indicate like or corresponding parts throughout the several views, a storage assembly is shown as including a housing means generally indicated at 20 for defining an enclosure. The housing means 20 includes a bottom or base 22. Extending upwardly from the base are left and right side walls 24 and 26 which are interconnected at the rear by a rear wall, not shown but readily understood and well-known in the art. A top wall, generally indicated at 28 in FIG. 5, extends across the left, right and rear walls to define the top of the enclosure. The housing means 20 also includes vertical side beams 30 and cross beams 32.

The housing means 20 is segmented into vertical drawer units stacked one upon the other at mating lines or seams 34 and flanges 36. These vertical segments or sections may be of various different vertical heights to accommodate drawers of various different vertical heights or depths. For example, some drawers may be of a vertical height for receiving the files of standard letter-size documents or for 3×5 or 5×8 index cards.

Figure 2:
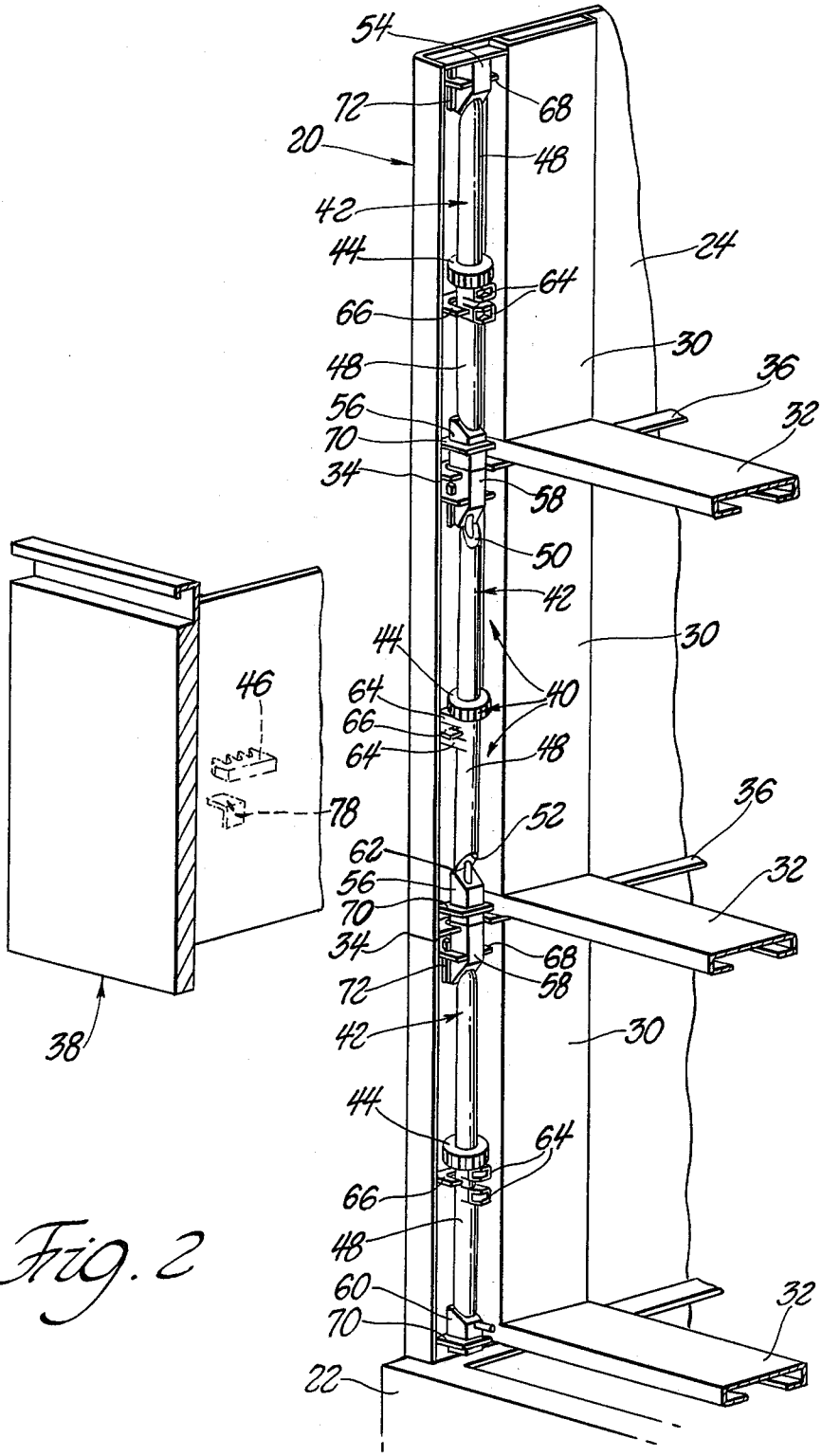
FIG. 2 is a fragmentary perspective view of the assembly shown in FIG. 1 to a different scale and with one of the drawers moved to the open position.

A plurality of storage drawer units are included but only one is generally indicated at 38 in FIG. 2. Each of the storage drawer units 38 is supported by a drawer slide hung from the housing means 20 for movement between a closed position within the enclosure and an open position as indicated in FIG. 2 extending out of the housing means 20.

Figure 6:
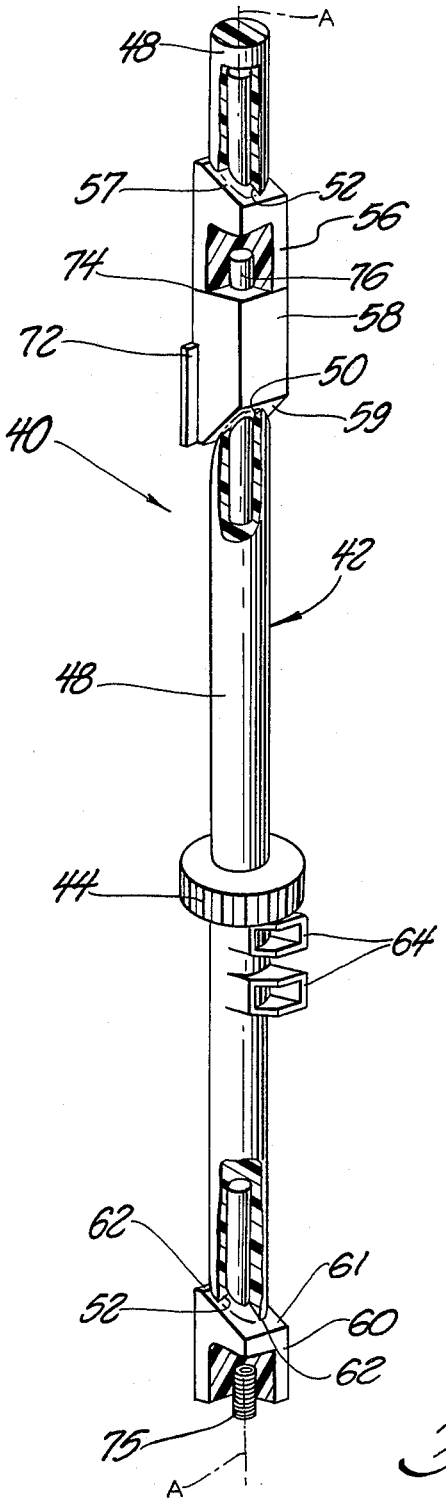
FIG. 6 is a fragmentary perspective view partially cut away and in cross section of a portion of the blocking means of the preferred embodiment illustrated in FIGS. 1 through 3.

The storage assembly includes blocking means generally shown at 40 disposed on a vertical axis A (as indicated in FIG. 6) along the left side of the storage units 38 for preventing opening movement from the closed position of all but one 38 of the storage units in response to opening movement of the one of the storage units 38. The blocking means 40 may be disposed on either side of the cabinet. The blocking means 40 includes a control means 42 associated with each storage unit 38. Each control means 42 is vertically movable between a neutral opening position allowing opening movement of the associated storage unit 38 and upper and lower blocking positions respectively vertically above and below the neutral opening position for preventing opening movement of the associated storage unit 38 in either of the blocking positions and for vertically moving all other control means 42 to their respective blocking positions while remaining in the neutral opening position in response to initial opening movement of the associated storage unit 38. All of the control means 42 illustrated in FIG. 1 are disposed in the vertically neutral opening position for allowing opening movement of any one of the storage drawer units 38. As illustrated in FIG. 2, the center storage unit 38 has been moved to the open position and the associated center control means 42 has remained in the vertically neural opening position while vertically moving the top control means 42 vertically upwardly to the upper blocking position and the lower control means 42 downwardly to the lower blocking position for preventing opening movement of the top or bottom storage units.

Each control means 42 includes a transmission means comprising a pinion gear 44 coacting with a rack 46 on the associated storage unit 38 for rotating the control means 42 between an unactivated position, in which position all control means 42 are shown except the middle control means 42 in FIG. 2, and an actuated position, which is the position of the middle control means 42 in FIG. 2. Each drawer storage unit 38 includes a rack 46 disposed on the side thereof and extending lengthwise in the direction of the opening movement for engaging and rotating the pinion gear 44 of the associated control means 42 during opening movement thereof. Each control means includes a shaft 48 having top 50 and bottom 52 ends. Each control means 42 includes shifting means defined by the cam surfaces at the top and bottom ends 50 and 52. The cam surfaces are inclined relative to the vertical axis A for vertically moving all other control means 42 from their respective neutral positions to respective blocking positions in response to rotation of the control means 42 from the unactuated position to the actuated position like the centrally disposed control means 42 of FIG. 2.

The blocking means 40 also includes link means comprising a plurality of link elements 54, 56, 58 and 60, between next adjacent control means 42 and movably supported by the housing means 20 for vertical movement. The link means 54, 56, 58 and 60 are responsive to the cam surfaces 50 and 52 of the shifting means for vertically moving all of the control means 42 in response to rotation of one of the control means 42 (i.e., the center control means 42 in FIG. 2) from the unactuated position upon initial opening movement of the associated storage unit 38. Each of the link elements 54, 56, 58 and 60 present an inclined cam surface for mating surfaceto-surface engagement with the cam surfaces 50 and 52 at the ends of the shafts 48 when the assembly is in the neutral position. The link element cam surfaces are illustrated in FIG. 6. The link element 56 includes a cam surface 57 which is inclined at the same angle and in mating surface engagement with the camming surface 52 at the bottom of the immediately adjacent shaft 48 when the assembly is in the unactuated position and all of the drawers are within the cabinet enclosure. In a similar fashion, the link element 58 has a cam surface 59 in surface-to-surface engagement with the top cam surface 50 of the adjacent shaft 48 when in the unactuated position. The link element 60 has an analogous cam surface 61. Accordingly, upon rotation of a shaft 48 of the control means 42, the cam surfaces 50 and 52 at the ends of the shaft 48 effect a wedging action with the adjacent cam surfaces of the adjacent link elements to vertically move the adjacent link elements. All of the cam surfaces terminate in a small horizontally disposed ledge 62, as shown at the bottom of FIG. 6. The ledges 62 rest upon one another when a shaft 48 has rotated to its fully actuated position, as illustrated by the centrally disposed shaft 48 and control means 42 of FIG. 2, for retaining the shaft 48 in the fully rotated or actuated position by frictional engagement between the ledges 62.

Each control means 42 includes lug means comprising a pair of vertically spaced lugs 64 extending radially from the shaft 48 for blocking engagement with the associated storage drawer unit 38 when in either of the upper and lower blocking positions, as illustrated by the top and bottom pairs of FIG. 2, and for rotating with the shaft 48 to the actuated position illustrated by the centrally disposed pair 64 of FIG. 2. A key means comprising a projection 66 extends from the housing means in vertical alignment with the space between the lugs 64 so that the projection 66 is disposed between the lugs 64 upon rotation of the shaft 48 by the pinion gear 44 from the unactuated position shown in FIG. 1 to the actuated position shown by the central control means 42 of FIG. 2. Accordingly, the projection 66 defines a key means which coacts between the housing means 20 and the control means 42 for limiting vertical movement of the control means 42 to the neutral position during rotation thereof between the unactuated and actuated positions as shown by the centrally disposed control means 42 of FIG. 2.

The assembly also includes guide means defined by the brackets 68 and 70 extending from the housing means 20 for preventing rotation of the link elements 54, 56, 58 and 60 about the vertical axis A while at the same time guiding vertical movement thereof. The brackets 68 are U-shaped but include an additional groove in the U-shaped pocket for receiving the laterally extending key 72 extending laterally from some of the link elements 54, 58, etc. for preventing removal of the link elements from the brackets 68. Other brackets 70 present closed openings through which the link elements are disposed. The link elements 54, 56, 58 and 60 have four-sided cross sections to coact with the brackets 68 and 70 to prevent rotation of the link elements about the vertical axis A. Specifically, the link elements are square in cross section. The link elements include a top element 54 or 58 engaging the top cam surface 50 of the control means 42 and a bottom element 56 or 60 engaging the bottom cam surface 52 of the control means 42. One of the top elements 54 or 58 mates with one of the bottom elements 56 or 60 at the division surfaces 34 between next adjacent housing sections or storage units or the openings therefor. In this manner, at least one shaft 48 and top 54, 58 and bottom 56, 60 elements are associated with each storage unit or opening in the housing enclosure. As best illustrated in FIG. 6, each shaft 48 has associated therewith a bottom element 60 or 56 and a top element 58 or 54 with there being a separation surface 74 between top and bottom link elements horizontally aligned in the unactuated position with the separation between vertically adjacent housing sections or compartments. As also shown in FIG. 6, each shaft 48 has a female bore extending into each end thereof and centrally disposed in the respective cam surfaces for receiving male pins extending from the cam surfaces of the adjacent link elements 54, 56, 58 and 60. In a similar fashion, a bore and pin axially align mating and engaging link elements as shown at 76.

A lost motion means comprising a spring 75 supports the stack of control means 42 and link elements in the vertically neutral positions and allows vertical movement of the link elements above and below each control means in opposite vertical directions in response to rotation of that control means to move all other link elements and control means to the blocking positions. This is best illustrated in FIG. 2 wherein the central control means 42 has been rotated to the actuated position raising the upper control means 42 upwardly as allowed by the lost motion space between the link element 54 and the top of the cabinet means and allowing the lower control means 42 to move downwardly compressing the spring 75. The spring 75 is of a sufficient spring weight to support the weight of all of the link elements and control means 42 in the neutral position for aligning the projections 66 with the spaces between the pairs of lugs 64. The spring 75 supports the lower most bottom link element 60 on the housing means 20 for up and down vertical movement thereof.

A spring 77 is disposed between the top link element 54 and the top of the housing for returning the control means 42 to the vertically neutral position. The spring force of the spring 77 is less than the spring 75. In fact, the spring 77, may be eliminated in some instances as gravity will return the stack to neutral.

The bottom 22 of the housing and a flange of the top of the housing define stop means for limiting the amount of vertical movement of the blocking means 40 for preventing simultaneous actuation of two of the control means 42 in response to simultaneous opening forces on two of the storage units 38. In other words, and as illustrated in FIG. 2, the upper link element 54 is prevented from moving upwardly any farther because of its butting engagement with the flange on the top of the housing enclosure and likewise the link element 60 at the bottom has fully compressed the spring 75 to engage the bottom of the housing, thereby limiting downward movement so that neither the upper shaft 48 nor the lower shaft 48 may be rotated thereby retaining the lugs 64 in the blocking positions illustrated and, further, preventing sufficient vertical movement to allow two of the shafts 48 to be rotated to the actuated position thereby preventing two drawers from being opened simultaneously.

A tab 78 extends from the side of each storage drawer unit as shown in phantom in FIG. 2. Each horizontally extending tab 78 is in vertical alignment with the space between the lugs 64 when in the neutral position. However, the tab 78 is aligned for blocking engagement with one of the lugs 64 when the lugs have been vertically shifted to one of the upper or lower blocking positions as in the case of the upper and lower control means 42 in FIG. 2.

Figure 3:
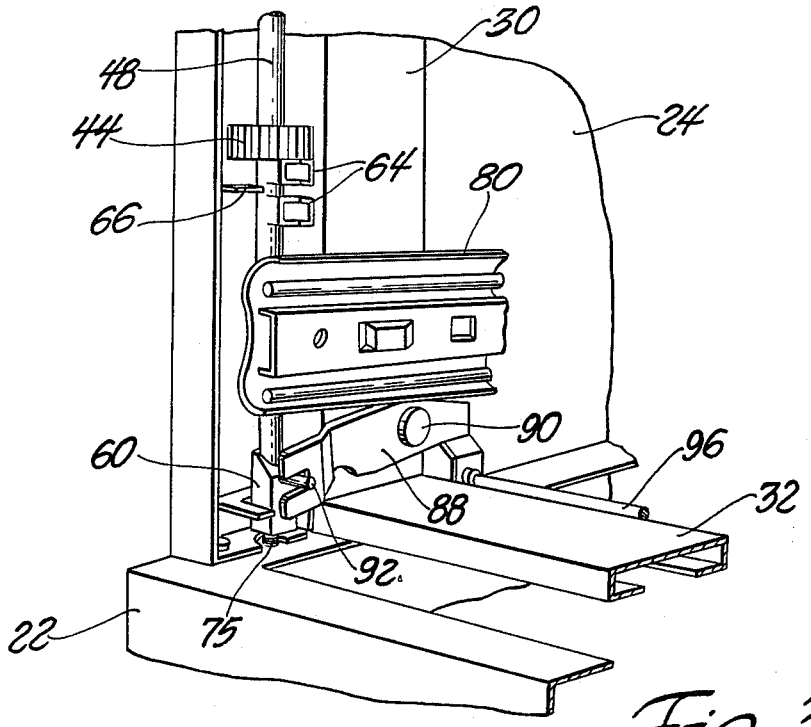
FIG. 3 is a fragmentary perspective view of the lower left-hand corner of a storage assembly constructed in accordance with the subject invention to illustrate the security locking system.
Figure 4:
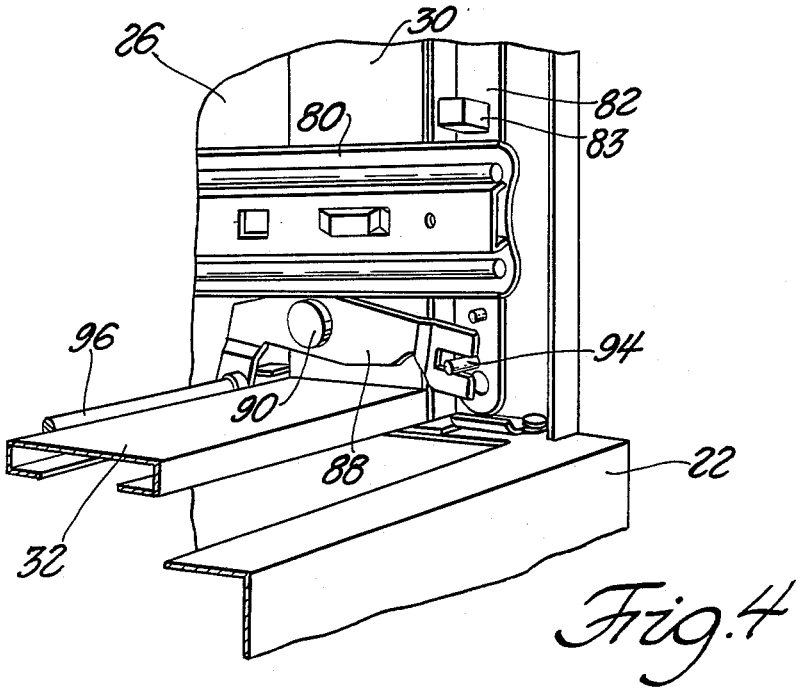
FIG. 4 is a fragmentary perspective view of the lower right-hand corner of a storage assembly constructed in accordance with the subject invention to illustrate the security locking system.
Figure 5:
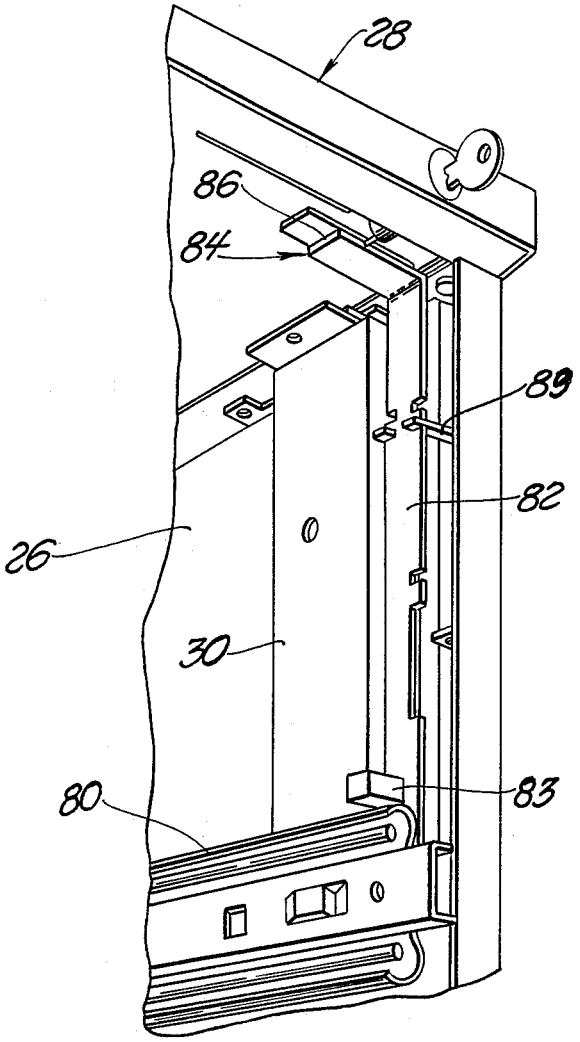
FIG. 5 is a fragmentary perspective view of the upper right-hand corner of a storage assembly constructed in accordance with the subject invention to illustrate the security locking mechanism.

Although only shown in FIGS. 3 through 5, the housing 20 would include slides or tracks 80 for slidably supporting the storage drawer units 48 in a fashion well known in the art.

The assembly also includes locking means independent of the blocking means 40 for vertically shifting all of the control means 42 to one of the blocking positions to prevent all of the storage drawer units 34 from being opened. The locking means includes a locking bar 82 supported for vertical movement by brackets 89 extending from the housing means along the opposite or right side of the storage units 38. A crossover means interconnects the lower end of the blocking means as illustrated in FIG. 3 and the lower end of the locking bar as illustrated in FIG. 4. A key lock assembly is included and is generally shown at 84 in FIG. 5 for movement from an unlocked position to a locked position for moving the locking bar 82 from a resting position upwardly to a locked position. Upon rotation of the key tumbler, a pin extending therefrom engages an L-shaped arm 86 for raising the locking bar 82. The crossover means is movably supported by the housing means 20 for vertically moving the blocking means 40 and all of the control means 42 therein upwardly from the neutral positions to the upper blocking positions. The crossover means includes a pair of rocker arms 88 pivotally supported by pins 90 on opposite sides of the housing means 20 for rocking movement about a pivot axis defined by the pins 90. The left-hand rocker arm 88 shown in FIG. 3 has a forked forward end operatively connected to the blocking means 40 by a pin 92. The other or right rocker arm 88 has a forward forked end operatively connected to the locking bar 82 by a pin 94. A tie rod 96 interconnects the opposite rear ends of the rocker arms 88 on the other side of the pivot axis of the pins 90. Accordingly, as the key assembly 84 is rotated, the locking bar 82 is raised to, in turn, rock the arm 88 to raise the tie rod 96 and thereby rotate the rocker arm 88 on the other side of the cabinet to move the entire string of link elements and shafts 48 upwardly to move all of the lower lugs 64 into horizontal blocking alignment with the respective tabs 78 for preventing the opening of all of the drawers of the storage assembly.

Although not shown, a key lock assembly may be disposed in the front flange of the housing to coact with one of the notches (not numbered) in the locking bar 82 to raise the locking bar 82 to the locked position.

The locking bar 82 includes a locking lug 83 for blocking horizontal engagement with a tab on the other side of the drawer unit 38 like the tab 78 when the locking bar 82 is raised to the locking position. Thus, when the key assembly 84 is moved to the locked position to raise the locking bar 82, the lugs 83 are moved upward into horizontal blocking engagement with the tabs on the side of the drawer units so that both sides of the drawer units are blocked from opening, i.e., they are locked on both sides.

DESCRIPTION OF THE ALTERNATIVE EMBODIMENTS OF FIGS. 7–9

The embodiment of FIG. 7 is particularly well-suited for use in a vertical-type file storage cabinet assembly and differs from the previous embodiment only in that the shaft 48' of the control means 42 is shorter and, therefore, the assembly includes longer link elements 54' and 58'.

The embodiment of FIG. 8 likewise has different lengths in the shafts 48" and employs an additional link element 98 to accommodate drawers of various different vertical heights or depths in a lateral-type filing assembly.

In a similar fashion, FIG. 9 shows a variation for use in the vertical-type file cabinet assembly for drawers of smaller vertical height and accordingly utilize different link elements 99. The link elements mate and are separable at the division between next adjacent storage units or vertical sections of the assemblies so that the blocking means 40 may be of variable lengths to accommodate various numbers of storage units. The link elements and the control means 42 are of different vertical dimensions, respectively, to accommodate storage units of various different vertical dimensions.

OPERATION

Normally, the assembly is in the unactuated position illustrated in FIG. 1 wherein the vertical stack of link elements and control means 42 are supported in a vertically neutral position by the spring 75. In this vertically neutral position, the tabs 78 extending from each drawer are aligned with the space between the lugs 64 on the associated control means 42. Upon the opening of a storage unit or drawer 38, the rack 46 thereof engages the associated pinion 44 to rotate the shaft 48 thereby rotating the lugs 64 clockwise as viewed from the top with the projection 66 disposed therebetween as illustrated by the middle drawer opening of FIG. 2. The projection 66 knifes the lugs 64 to prevent any substantial vertical movement of the associated shaft 48 thereby allowing the tab 78 of the drawer to move between the lugs 64 and out of the opening. At the same time, the cam surfaces 50 and 52 effect a wedging action with the cam surfaces of the adjacent link elements to vertically move the adjacent link elements up and down as the case may be. The link elements are prevented from being rotated and are therefore forced upwardly and downwardly depending upon whether they are disposed above or below the rotated shaft 48. As illustrated in FIG. 2, the top shaft 48 is moved vertically upwardly because of the coaction between the camming surface 50 at the top end of the middle shaft 48 and the next above link element 58 to thereby move the lowermost lug 64 into blocking engagement with the tab 78 on the adjacent top drawer. Accordingly, the drawer or storage unit 38 of the top opening in FIG. 2 is prevented from moving outwardly to the open position. In a similar but opposite position, the lower camming surface 52 of the middle shaft 48 moves the next adjacent link element 56 downwardly to move the lowermost shaft 48 downwardly to move the lug means 64 to the lower blocking position with the tab 78 on the adjacent or bottom drawer preventing it from being opened and moving the top lug 64 of the pair into horizontal blocking alignment with the adjacent or lowermost projection 66. The shaft 48 rotated to the actuated position is rotated approximately 180° as shown by the middle shaft in FIG. 2 so that the horizontal shelf surfaces 62 rest upon one another to frictionally hold the shaft 48 in the rotated actuated position. When the drawer 38 is returned to the closed position, the rack 46 thereof engages the pinion gear 44 to rotate the shaft 48 in the counterclockwise direction as viewed from the top to return the assembly to the unactuated vertically neutral position. The space for vertical movement of the entire stack of elements is limited by the space between the uppermost link element 54 and the housing and the space between the lowermost link element 60 and the housing whereby there is not sufficient room to rotate two of the shafts 48 at the same time.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A storage assembly comprising; a housing means (20) defining an enclosure, a plurality of storage units (38) each supported by said housing means (20) for movement between a closed position within the enclosure and an open position extending out of said housing means, and blocking means (40) disposed on a vertical axis (A) along side of said storage units (38) for preventing opening movement from said closed position of all but one of said storage units (38) in response to opening movement of said one of said storage units (38), said blocking means (40) characterized by including control means (42) associated with each storage unit (38) and vertically movable between a neutral opening position allowing opening movement of the associated storage unit (38) and upper and lower blocking positions respectively vertically above and below said neutral opening position for preventing opening movement of the associated storage unit (38) in either of said blocking positions and for vertically moving all control means (42) thereabove upwardly to their respective blocking positions and for vertically moving all control means (42) therebelow downwardly to their respective blocking positions while remaining in said neutral opening position in response to initial opening movement of the associated storage unit.

2. An assembly as set forth in claim 1 further characterized by each control means (42) including; transmission means (44) coacting with the associated storage unit (38) for rotating said control means (42) between an unactuated position and an actuated position, and key means (66) coacting between said housing means (20) and said control means (42) for limiting vertical movement of said control means (42) to said neutral position during rotation thereof between said unactuated and actuated positions.

3. An assembly as set forth in claim 2 further characterized by each control means (42) including shifting means (50,42) for vertically moving all other control means (42) from their respective neutral positions to respective blocking positions in response to rotation of said control means (42) from said unactuated position to said actuated position.

4. An assembly as set forth in claim 3 further characterized by said blocking means (40) including link means (54,56,58,60,54',58',98,99) movably supported by said housing means (20) and responsive to said shifting means (50,52) for vertically moving all of said control means (42) in response to rotation of one of said control means (42) from said unactuated position upon initial opening movement of the associated storage unit (38).

5. An assembly as set forth in claim 4 further characterized by said link means including a plurality of link elements (54,56,58,60,54',58',98,99) between next adjacent control means (42); said elements mating and being separable at the division (34) between next-adjacent storage units (38) so that the blocking means (40) may be of variable lengths to accommodate various numbers of storage units (38).

6. An assembly as set forth in claim 5 further characterized by said link means and said control means (42) being of different vertical dimensions to accommodate storage units (38) of various different vertical dimensions.

7. An assembly as set forth in claim 4 further characterized by each control means (42) including lug means (64) extending radially for blocking engagement with the associated storage unit (38) when in said upper and lower blocking positions and for rotating with said control means (42) to said actuated position.

8. An assembly as set forth in claim 7 further characterized by said key means (66) coacting with said lug means (64) during rotation of said control means (42) from said unactuated position to said actuated position for limiting said vertical movement of the associated control means (42) during rotational movement thereof.

9. An assembly as set forth in claim 8 further characterized by including guide means (68,70) extending from said housing means (20) for preventing rotation of said link means ((54,56,58,60,54',58',98,99) about said vertical axis (A) while guiding vertical movement thereof.

10. An assembly as set forth in claim 9 further characterized by including lost motion means (76) for supporting the stack of control means (42) and link means (54,56,58,60,54',58',98,99) in said vertically neutral positions and for allowing vertical movement of the link means above and below each control means (42) in opposite vertical directions in response to rotation thereof to move all other link means and control means (42) to said blocking positions.

11. An assembly as set forth in claim 10 further characterized by each control means (42) including a shaft (48) having top (50) and bottom (52) ends, said shifting means comprising cam surfaces at said top and bottom ends and inclined relative to said vertical axis (A) for effecting a wedging action with the adjacent link means (54,56,58,60,54',58',98,99) to vertically move same.

12. An assembly as set forth in claim 11 further characterized by said transmission means comprising a pinion gear (44) extending about said shaft (48), a rack (46) extending from each storage unit (38) for engaging and rotating the pinion gear (44) of the associated control means (42) during opening movement thereof.

13. An assembly as set forth in claim 12 further characterized by said link means including a top link element (54,5,54',98,99) engaging said top cam surface (50) and a bottom link element (56,60,56',98) engaging said bottom cam surface (52).

14. An assembly as set forth in claim 13 further characterized by each of said top and bottom elements having a four-sided cross section to coact with said guide means (68,70) to prevent rotation of said elements about said vertical axis (A).

15. An assembly as set forth in claim 14 further characterized by one (58,58') of said top elements mating with one (56,56') of said bottom elements at the division (34) between next-adjacent storage units so that a shaft (48) and top and bottom elements are associated with each storage unit (38).

16. An assembly as set forth in claim 15 further characterized by said lost motion means comprising a spring (76) supporting the lower-most bottom element (60) on said housing means (20) for up and down vertical movement of said lower-most bottom element (60).

17. An assembly as set forth in claim 16 further characterized by said lug means comprising a pair of vertically spaced lugs (64) extending radially from said shaft (48) and said key means comprises a projection (66) extending from said housing means (20) in vertical alignment with the space between said lugs (64) so that said projection (66) is disposed between said lugs (64) upon rotation of said shaft (48) by said pinion gear (44) from said unactuated position.

18. An assembly as set forth in claim 17 further characterized by including a tab (78) extending from each storage unit (38) in vertical alignment with the space between said lugs (64) when in said neutral position and aligned for blocking engagement with said lugs (64) when in said blocking position.

19. An assembly as set forth in either of claims 1, 4 or 18 further characterized by including independent locking means for vertically shifting all of said control means (42) to one of said blocking positions to prevent all of said storage units (38) from being opened to lock the assembly for security.

20. An assembly as set forth in claim 19 further characterized by said locking means including a locking bar (82) supported for vertical movement along the opposite side of said storage (38) and a crossover means interconnecting the lower end of said blocking means (40) and the lower end of said locking bar (82).

21. An assembly as set forth in claim 20 further characterized by said locking means including a lock (84) movable from an unlocked position to a locked position for moving said locking bar (82) from a resting position to a locked position, said crossover means being movably supported by said housing means (20) for vertically moving said blocking means (40) and all of said control means (42) therein upwardly from said neutral positions to said upper blocking positions.

22. An assembly as set forth in claim 21 further characterized by said crossover means including a pair of rocker arms (88) pivotally supported (90) by said housing means (20) on opposite sides of the bottom storage unit for rocking movement about a pivot axis, one of said rocker arms (88) having its forward end operatively connected (92) to said blocking means (40) and the other of said rocker arms (88) having its forward end operatively connected (94) to said locking bar (82), a tie rod (96) interconnecting the opposite rear ends of said rocker arms (88) on the other side of said pivot axis (90) from said forward ends thereof.

23. An assembly as set forth in any one of claims 1, 3, 4, 10, 16 or 18 further characterized by including stop means limiting the amount of vertical movement of said blocking means (40) for preventing simultaneous actuation of two of said control means (42) in response to simultaneous opening forces on two of said storage units.

24. A storage assembly comprising; a housing means (20) defining an enclosure, a plurality of storage units (38) each supported by said housing means (20) for movement between a closed position within the enclosure and an open position extending out of said housing means, and blocking means (40) disposed on a vertical axis (A) along side of said storage units (38) for preventing opening movement from said closed position of all but one of said storage units (38) in response to opening movement of said one of said storage units (38), said blocking means (40) control means (42) associated with each storage unit (38) for allowing opening movement of the associated storage unit (38) for preventing opening movement of the associated storage unit (38); each control means (42) including transmission means (44) coacting with the associated storage unit (38) for rotating said control means (42) between an unactuated position and an actuated position, shifting means (50, 42) for vertically moving all other control means (42) in response to rotation of said control means (42) from said unactuated position to said actuated position, said blocking means (40) including link means (54,56,58,60,54',58',98,99) movably supported by said housing means (20) and responsive to said shifting means (50,52) for vertically moving all of said control means (42) in response to rotation of one of said control means (42) from said unactuated position upon initial opening movement of the associated storage unit (38), each control means (42) including a shaft (48) having top (50) and bottom (52) ends, said shifting means comprising cam surfaces at said top and bottom ends and inclined relative to said vertical axis (A) for effecting a wedging action with the adjacent link means (54,56,58,60,54',58',98,99) to vertically move same, said link means and shafts (48) being independent and separately stacked along said vertical axis (A), and guide means (68,70) extending from said housing means (20) for engaging the exterior of and preventing rotation of said link means (54,56,58,60,54',58',98,99) about said vertical axis (A) while grinding vertical movement thereof, said shafts (48) stacked among said link means for rotation independently of said link means.

25. An assembly as set forth in claim 24 further characterized by including lug means (64) extending radially from said shafts (48) for blocking engagement with the associated storage unit (38) and for rotating with said associated shaft (48) to said actuated position.

26. An assembly as set forth in claim 25 further characterized by key means (66) extending from said housing means (20) for coacting with said lug means (64) during rotation of said associated shaft (48) from said unactuated position to said actuated position for limiting vertical movement of the associated shaft (48) during rotational movement thereof.

27. An assembly as set forth in claim 26 further characterized by including lost motion means (76) for supporting the stack of said shafts (48) and link means (54,56,58,60,54',58',98,99) in a neutral opening position allowing opening movement of the associated storage unit (38) and for allowing vertical movement of the link means above and below each actuated shaft (48) in opposite vertical directions in response to rotation thereof to move all other link means and shafts to said blocking positions.

28. An assembly as set forth in claim 27 further characterized by said lug means comprising a pair of vertically spaced lugs (64) extending radially from said shaft (48) and said key means comprises a projection (66) extending from said housing means (20) in vertical alignment with the space between said lugs (64) so that said projection (66) is disposed between said lugs (64) upon rotation of said shaft (48) from said unactuated position to prevent vertical movement of the associated shaft in either direction from said neutral opening position.

* * * * *